US007073811B2

(12) United States Patent
Puget

(10) Patent No.: US 7,073,811 B2
(45) Date of Patent: Jul. 11, 2006

(54) SKI

(75) Inventor: Nicolas Puget, Annecy le Vieux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/856,990

(22) Filed: Jun. 1, 2004

(65) Prior Publication Data

US 2005/0161908 A1 Jul. 28, 2005

(30) Foreign Application Priority Data

Jun. 2, 2003 (FR) ..... 03 06615

(51) Int. Cl.
*A63C 5/048* (2006.01)

(52) U.S. Cl. ..... 280/610; 280/220; 280/11.12; 280/601

(58) Field of Classification Search ..... 280/286.02, 280/609, 610, 608
See application file for complete search history.

(56) References Cited

U.S. PATENT DOCUMENTS 4,971,350 A * 11/1990 Fagot ..... 280/609
5,002,300 A * 3/1991 Pascal et al. ..... 280/602
5,678,841 A * 10/1997 Bauvois ..... 280/608
6,241,272 B1 * 6/2001 Hammerle ..... 280/609

FOREIGN PATENT DOCUMENTS

| | | |
|---|---|---|
| EP | 0907390 | 4/1999 |
| FR | 2773718 | 7/1999 |

* cited by examiner

*Primary Examiner*—Christopher P. Ellis
*Assistant Examiner*—Cynthia F. Collado
(74) *Attorney, Agent, or Firm*—Greenblum & Bernstein, P.L.C.

(57) ABSTRACT

A ski having a central core, a lower reinforcement sub-assembly located beneath the core and resting on a gliding sole that is edged with two lateral running edges, and an upper reinforcement sub-assembly located above the core, and coated with a decoration layer, each of the reinforcement sub-assemblies having one or more layers, at least one of the upper reinforcement layers having a central portion, and at least one lateral portion. At least one of the reinforcement layers of the upper reinforcement sub-assembly has an asymmetrical structure in the area of its lateral portions, along at least a portion of its length. The invention also relates to a pair of skis, in which each of the skis is symmetrical to the other in mirror symmetry.

10 Claims, 7 Drawing Sheets

23
20c
21c
11
21
20
19
21a
6
13
14
20a
15
9
10
8
17
16
18

32
32c
31
31b
32b
31c
31a
32a
26
33
34

90
96
98
99
90a
96a
96b
93
98a
98b
99a
99b
92
94
90c
96c
98c
99c 100
101
102
103
100b
100a
102b
103b
102a
103a
101b
104
101a
100c
101c
102c
103c

SKI

CROSS-REFERENCE TO RELATED APPLICATION

This application is based upon French Patent Application No. 03.06615, filed Jun. 2, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to a ski, particularly a ski for alpine skiing, as well as to a pair of such skis to be used by a skier.

2. Description of Background and Relevant Information

As known, a ski has a central core that is surrounded by reinforcement layers and which has, on its bottom, a gliding sole with two running edges, and, on top, a decoration layer.

In recent years, ski manufacturing techniques have evolved with the advent of the so-called "carving" technique used by skiers. The ski dimension line has been accentuated, and the ski length reduced. In turns, instead of having the skier's weight borne mainly by one ski, the skier maintains support on both skis which are maintained spaced apart.

To take this new ski manufacturing technique into account, one has considered providing the ski with an asymmetrical structure.

Thus, patent publication EP 0 907 390, and U.S. Pat. No. 6,241,272, for example, disclose a pair of skis in which each ski has running edges that are inwardly curved, along asymmetrical curves, such that the inner running edge of one ski and the outer running edge of the other ski have the same curvature center in view of the relative position that the skier imposes on these two skis in a turn on snow.

This construction method yields satisfactory results. However, it mainly affects the trajectory of the ski.

SUMMARY OF THE INVENTION

An object of the present invention is to propose a ski with asymmetrical construction, according to the "carving" technique, that is far more adapted to skiing.

To this end, the invention proposes a ski having a central core, a lower reinforcement sub-assembly located beneath the core and resting on a gliding sole that is bordered by two lateral running edges, and an upper reinforcement sub-assembly located on top of the core and coated with a decoration layer, each of the reinforcement sub-assemblies having one or more layers, at least one of the upper reinforcement layers having a central portion covering the top of the core, and at least one lateral panel/portion extending downwardly toward one running edge. At least one of the reinforcement layers of the upper reinforcement sub-assembly has an asymmetrical structure in the area of its lateral surfaces, along at least a portion of its length.

In this way, an asymmetry is introduced in the structure of the ski shell. Because this shell ensures the transmission of the forces between the top of the ski and the running edges, the skier's support on one and the other of the running edges can be managed in a different manner.

BRIEF DESCRIPTION OF THE INVENTION

The invention will be better understood from the following description and the attached drawing, in which.

DETAILED DESCRIPTION OF THE INVENTION

Figure 2:
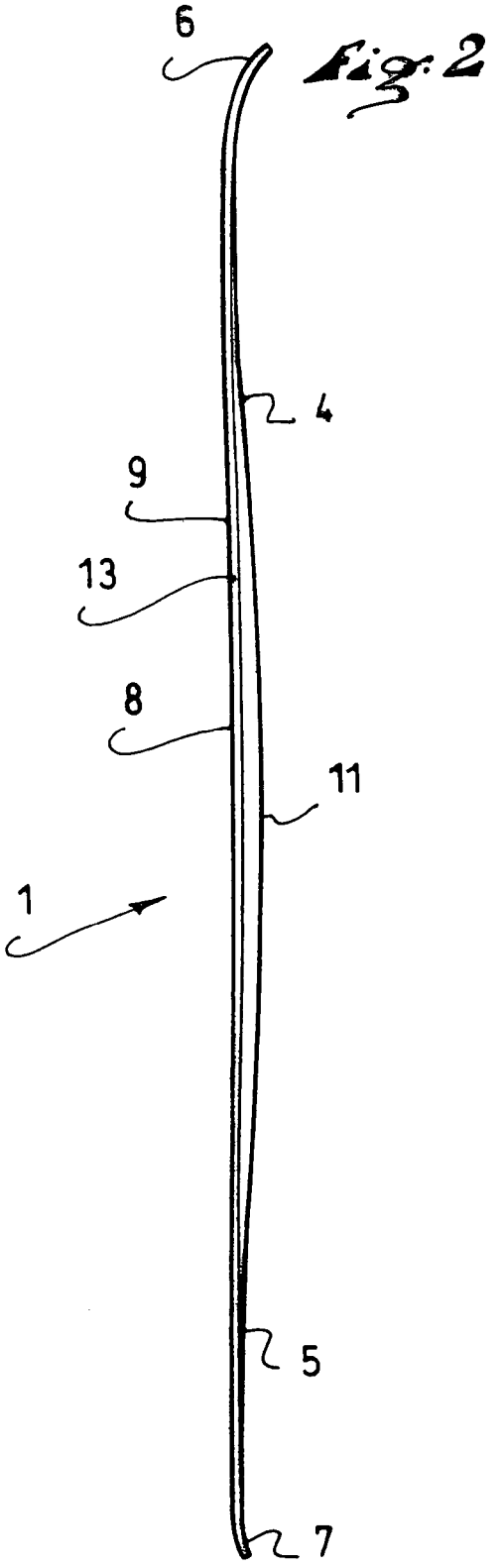
FIG. 2 shows a side view of the ski of FIG. 1.
Figure 1:
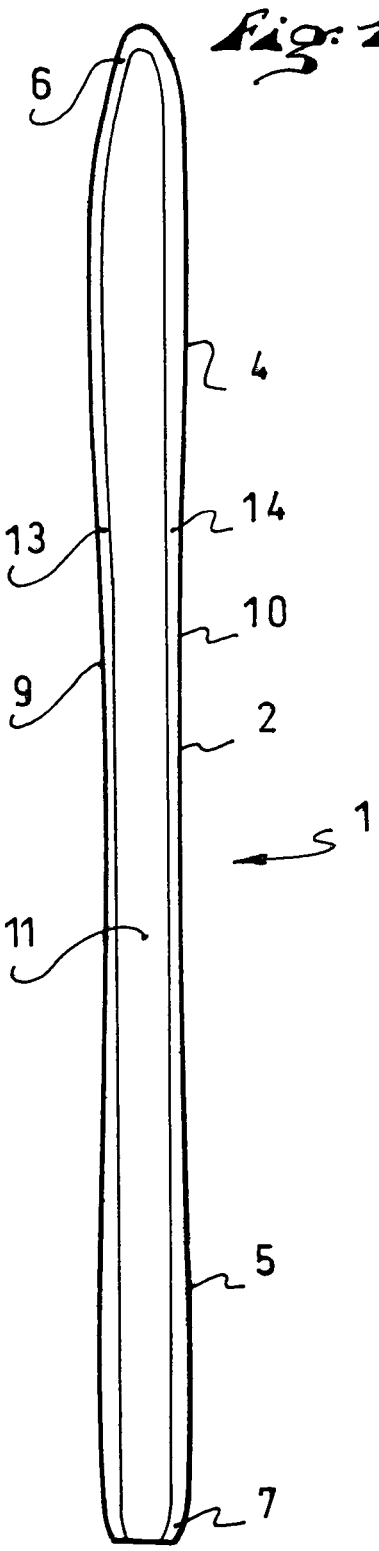
FIG. 1 shows a top view of a ski.
Figure 3:
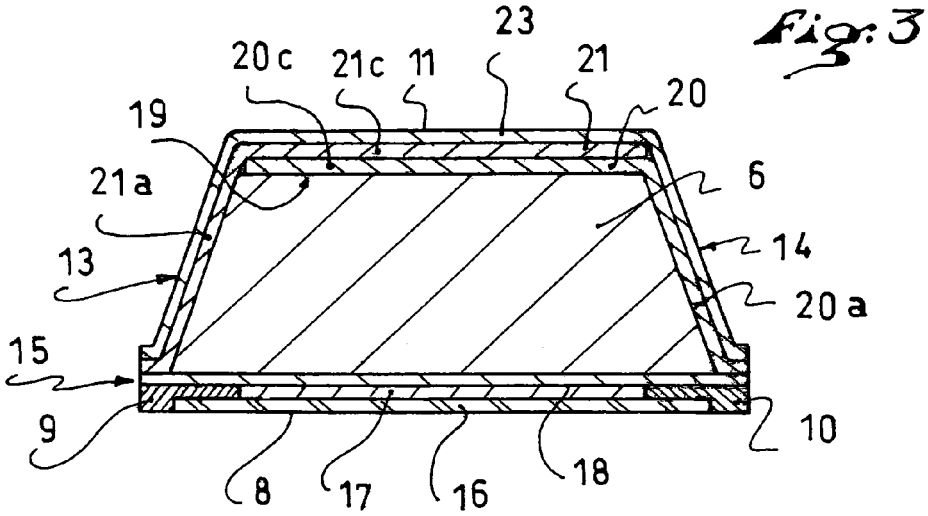
FIGS. 3–9 show transverse cross sections of the ski according to various respective embodiments of the invention.

The ski shown in FIG. 1 is in the form of a beam 1 elongated along a longitudinal direction and slightly cambered in a vertical plane.

According to convention, the ski has a central portion 2 provided to receive the elements for retaining the boot, i.e., the ski bindings, and front and rear portions 4 and 5 that end with the shovel 6 and heel 7, respectively.

Also according to convention, the ski has a lower gliding surface 8 that is bordered by two running edges 9 and 10, an upper decoration surface 11 and lateral edges, or side walls, 13 and 14 between the upper surface and the lateral running edges.

In cross section, the ski structure has a central core 6. The core is made of any appropriate material, such as wood, injected foam, or machined foam, such as, for example, polyurethane foam. As known, the cross-sectional dimensions can vary over the length of the ski, and the ski can be formed of a plurality of elements juxtaposed transversely and/or vertically.

The core 6 rests on a lower reinforcement sub-assembly 15, which in turn rests on a gliding sole 16. The gliding sole 16 provides the lower gliding surface 8.

According to the embodiment shown, the lower reinforcement sub-assembly 15 has two reinforcement layers, a lower layer 17 made of resin-impregnated fibers, and a metallic reinforcement layer 18 made of aluminum alloy, for example. The reinforcement layers can be formed of a plurality of sub-layers.

An upper reinforcement sub-assembly 19 is arranged above the core 6. Preferably, it has the same type of structure as the lower sub-assembly, with a metallic reinforcement layer 20 and a reinforcement layer 21 made of resin-impregnated fibers or fiber-reinforced resin.

The assembly is coated with an outer layer 23 that is decorated and provides the upper decoration layer 11.

As mentioned above, the reinforcement sub-assemblies preferably have the same type of structure on the top and bottom of the core in order to ensure stability in the ski camber.

According to a particularity of the invention, the ski structure is not the same along the two lateral sides of the ski. It is known that substantial forces traverse these zones, particularly when the skier executes turns. Having a different structure makes it possible to manage the ski support differently on its outer and inner running edges and, therefore, to manage the support of the inner and outer skis differently in turns.

According to the embodiment shown, the metallic reinforcement layer 20 has a central portion 20*c* that covers the top of the core, and a lateral panel/portion 20*a* of this layer that extends downwardly along a single ski side, namely, the side 14. On the other side, the reinforcement layer stops at the junction between the top of the core and the opposing side 13. The reinforcement layer 21 made of fibers has a central portion 21*c* that covers the top of the core, and a lateral panel/portion 21*a* that extends downwardly along the other side 13 of the ski. The reinforcement layer 21 does not cover the opposing side 14.

These two layers 20, 21 join the running edges 9 and 10 or, as shown in the figures, the two layers 20, 21 extend downwardly until they meet the lower reinforcement sub-assembly which might have a reinforcement element on top of the running edges. Thus, the ski has a hybrid box structure with two reinforcement layers 20, 21 superimposed on the top and bottom of the core 6, a connecting metallic reinforcement along one side and a connecting reinforcement made of fibers on the other.

The ski structure that is similar on the top and bottom of the core ensures stability in the camber of the ski. The lateral metallic portion provides a powerful grip; the lateral portion made of fibers makes it possible to apportion the grip of the ski on snow.

For a pair of skis, the lateral reinforcements are arranged with mirror symmetry in the area of their lateral portions. Under these conditions, the metallic lateral portions are preferably located on the outside of the skis and the sides made of fibers on the inside. However, this is not limiting, and one can proceed inversely, with the metallic lateral portions located on the inside.

Figure 4:
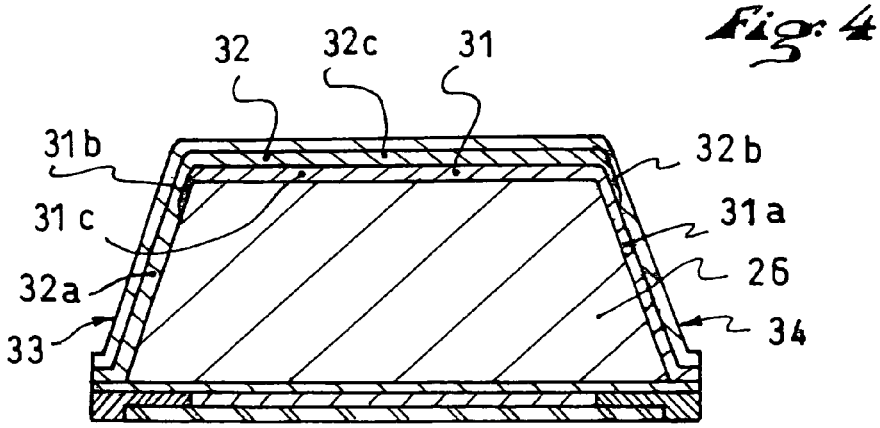

FIG. 4 relates to an alternative embodiment. According to this alternative, instead of stopping at the junction between the top of the core 26 and one of the sides 33 or 34 of the ski, the reinforcement layers 31 and 32 have lateral flaps 31*b* and 32*b* that extend the central portion 31*c*, 32*c* on the side opposite the lateral portions 31*a*, 32*a*, and which cover the ski sides over only a portion of their height. This construction method facilitates the centering of the reinforcements on the core, in particular for a metallic reinforcement when it is shaped beforehand.

As an alternative, one could have only one flap on one of the reinforcement layers.

Figure 5:
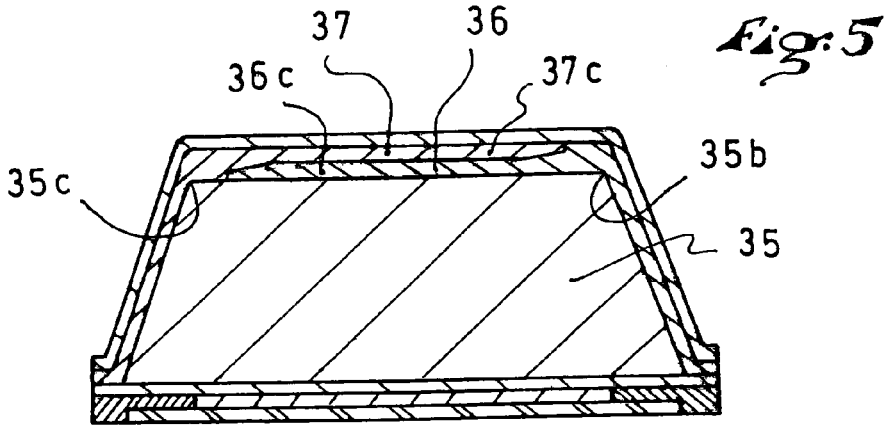

As shown in FIG. 5, instead of being extended by a flap, the central portion 36*c*, 37*c* of the reinforcement layers 36, 37 can be truncated and set back from the lateral edge 35*b*, 35*c* of the core 35, on their side that is not extended by a lateral panel/portion. This is shown in FIG. 5 for the reinforcement layers 36 and 37. In a variation, only one of the layers could be transversely truncated.

Figure 6:
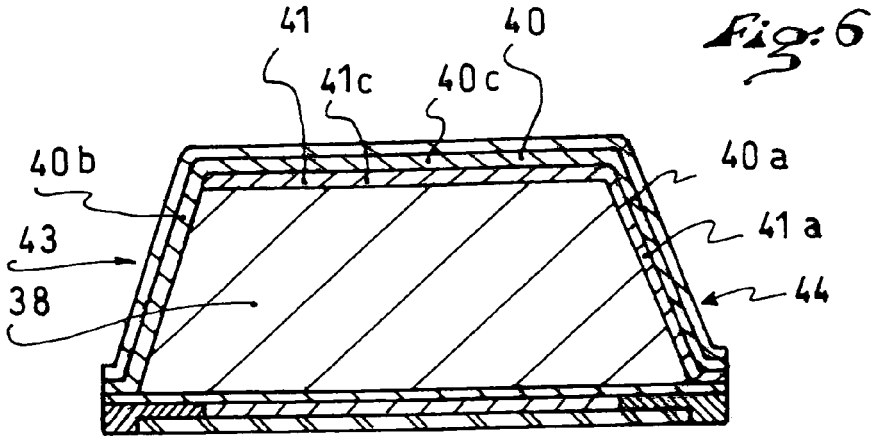

According to the construction of FIG. 6, the core 38 is coated with two reinforcement layers 40 and 41. The layer 40 has a central portion 40*c* that extends over the upper surface of the core 38 and a lateral panel/portion 40*a*, 40*b* that extends downwardly along each of the two sides 43 and 44 of the ski toward the running edges so as to form an upper reinforcement shell.

The other reinforcement layer 41 is asymmetrical; it has a central portion 41*c* that covers the upper surface of the core 38 and a panel/portion 41*a* that extends downwardly along a single side, namely, the side 44.

According to the embodiment shown, the asymmetrical reinforcement layer is positioned beneath the symmetrical layer, on top of the core. This is not limiting, and an opposite arrangement is also suitable.

In these various constructions, the reinforcement layers can be of the same type, in particular layers made of resin-impregnated fibers, or they can be of different types, in particular a reinforcement layer made of fibers and a metallic reinforcement layer, or yet two layers of fibers of different types, for example, glass, carbon, or aramid fibers embedded in an epoxy matrix. One can also use layers whose fibers have different orientations, for example, a longitudinal orientation and a transverse orientation, or yet oblique orientations with respect to the longitudinal direction of the ski, on both sides of the longitudinal direction defined by the ski, or yet layers of having different densities.

Figure 7:
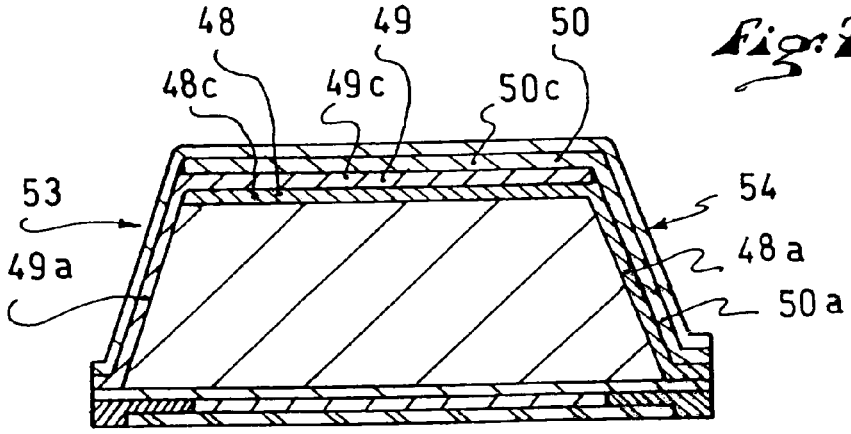

FIG. 7 relates to another alternative embodiment of the invention. The upper reinforcement sub-assembly has three reinforcement layers 48, 49, and 50. On top of the core, the central portions 48*c*, 49*c*, 50*c* of the three reinforcement layers are superimposed, with the layer 49 inserted between the layers 48 and 50. Conversely, along the sides of the ski, the reinforcement layers are arranged asymmetrically. In the embodiment shown, the panel/portion 49*a* of the intermediate layer 49 extends downwardly along one of the sides of the ski, namely, the side 53, and lateral panels/portions 48*a* and 50*a* of the other layers extend downwardly along the other side of the ski, namely, the side 54.

As in the preceding cases, the layers 48, 49, and 50 are of the same type, or of different types depending on their material, density and/or the fiber orientation.

Figure 8:
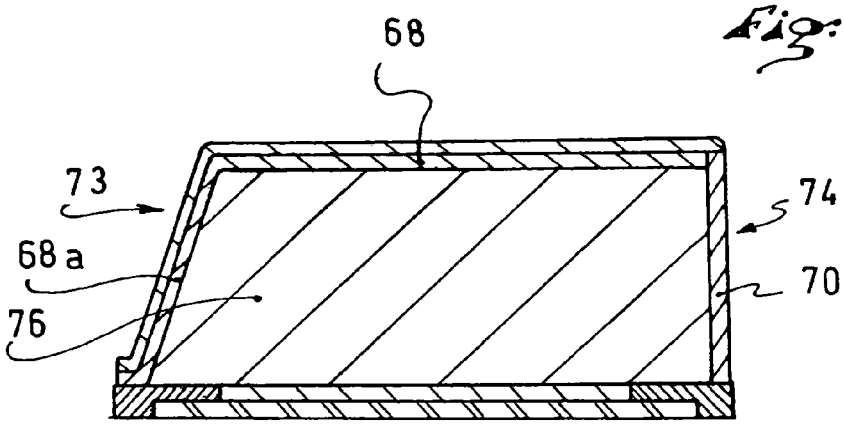

According to the embodiment shown in FIG. 8, the upper reinforcement 68, or more generally the upper sub-assembly, has a single lateral panel/portion 68*a* that extends downwardly along one of the ski sides, namely, the side 73. Along the other side 74 of the ski, a neutral element, such as an edge 70, made of phenol or ABS, is pressed against the core 76. In this way, the ski has a mono-shell type structure along one of its sides and a sandwich type structure along the other side.

Figure 9:
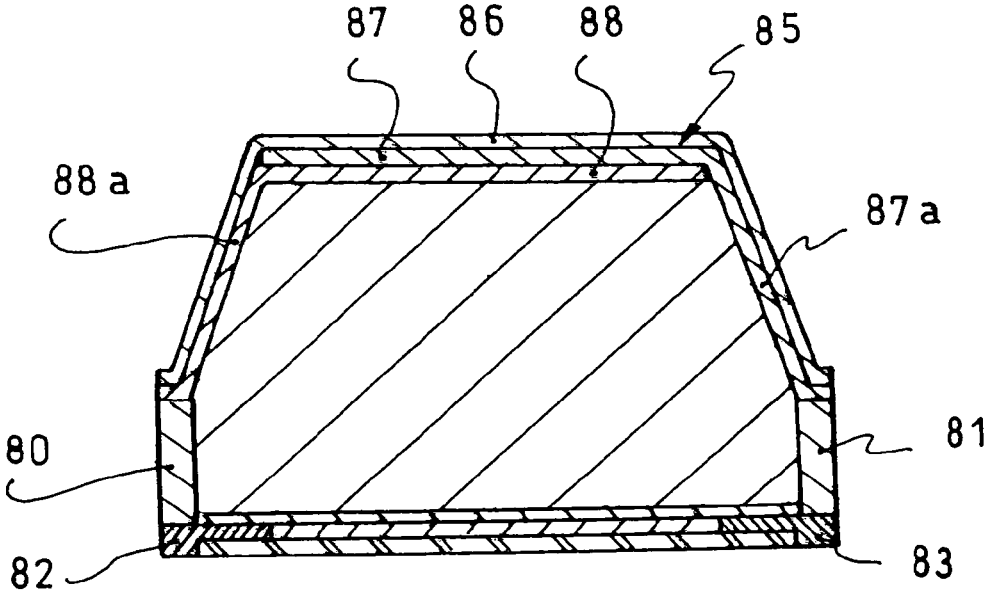

The embodiment of FIG. 9 is different from the preceding embodiments in that two spacers 80 and 81 rest edgewise on the running edges 82 and 83. Instead of resting on the running edges, the upper sub-assembly 85 and the decoration layer 86 rest on top of the spacers 80 and 81.

As in the preceding case, the upper reinforcement sub-assembly 85 has an asymmetrical structure. According to the embodiment shown, the sub-assembly 85 has two layers 87 and 88 having lateral panels/portions 87*a*, 88*a* that extend downwardly in the direction of each of the spacers 80, 81. Other asymmetrical structures could be used.

In a variation, the ski could have a spacer on only side of the ski.

Along the longitudinal direction of the ski, the asymmetry of the ski structure can be homogeneous or heterogeneous.

Figures 10, 11, 12, 13:
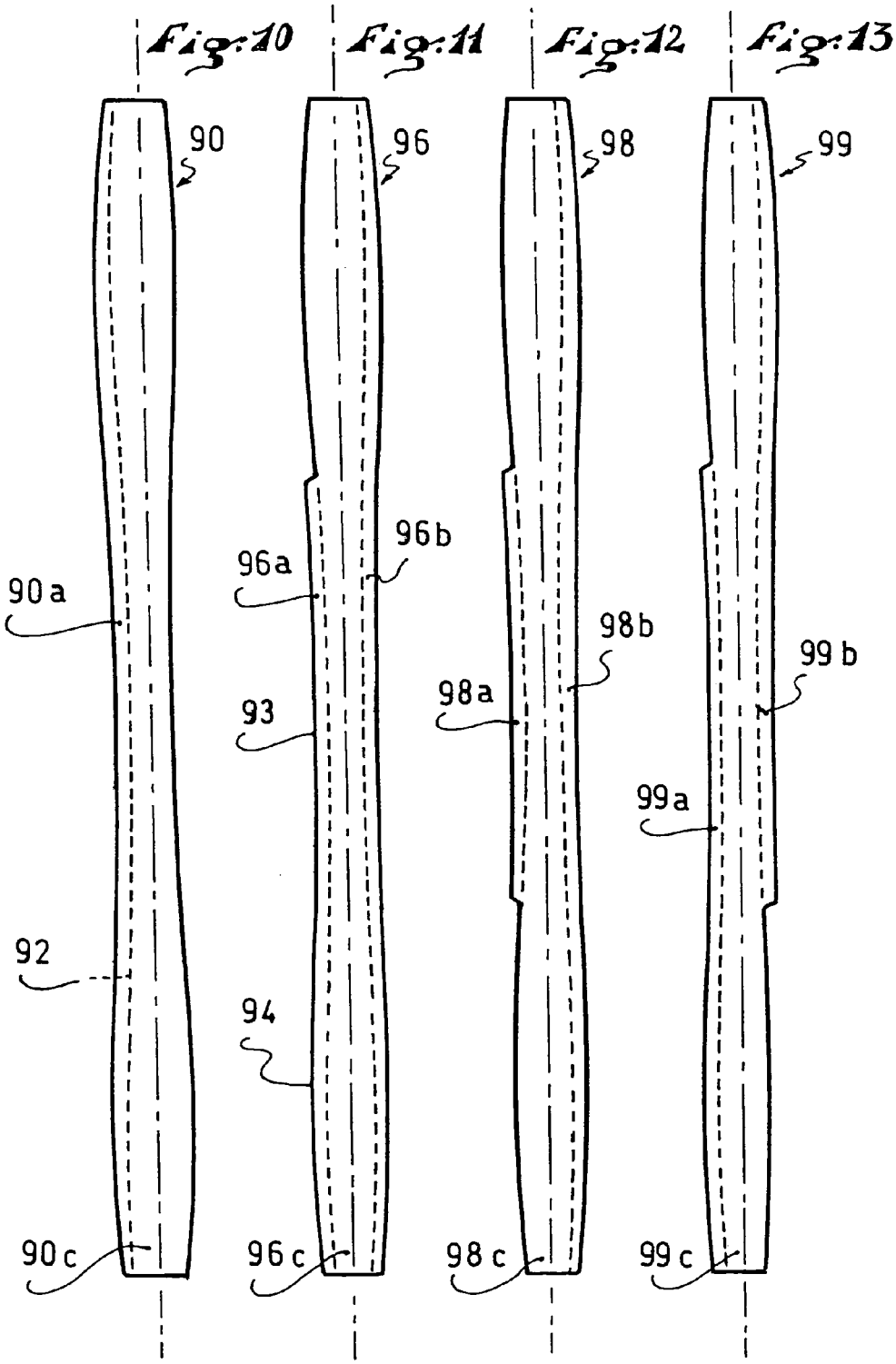
FIGS. 10–17 show top and developed views of reinforcement layers according to various embodiments of the invention.

FIG. 10 and the following drawing figures show a top and developed view of an upper reinforcement layer for various ski constructions. In these figures, the broken lines represent the fold line between the central portion of the reinforcement and its lateral panel(s)/portion(s).

FIG. 10 shows a reinforcement layer 90 having a central portion 90*c* extended on only one edge and over the entire length of the reinforcement by a lateral panel/portion 90*a*. The broken line designated by the reference numeral 92 represents the fold line of the reinforcement layer. There is no lateral panel/portion on the other side of the central portion 90*a*.

FIG. 11 shows an alternative construction. The reinforcement 96 has a central portion 96*c* and two lateral panels/portions 96*a*, 96*b* that extend over the central portion 93 and the rear portion 94 of the ski. In the front portion, one of the lateral panels/portions, in this case the panel/portion 96*a*, is cut along the fold line. As a result, it is discontinuous over the length of the reinforcement.

Such a reinforcement has a symmetrical structure in the rear portion and central portion, and an asymmetrical portion in the front portion. An opposite arrangement could also be suited.

For the reinforcement 98 shown in FIG. 12, one of the lateral panels/portions, in this case the panel/portion 98*a*, is also discontinuous. It is only present in the central portion; the other panel/portion 98*b* is present over the entire length of the reinforcement.

FIG. 13 shows another alternative embodiment of a discontinuous lateral panel/portion with a reinforcement 99, one of the lateral panels/portions of which, namely the panel/portion 99*a*, extends in the rear portion and the central portion, and the lateral panel/portion 99*b* is present in the central portion and the front portion.

Figures 14, 15, 16, 17:
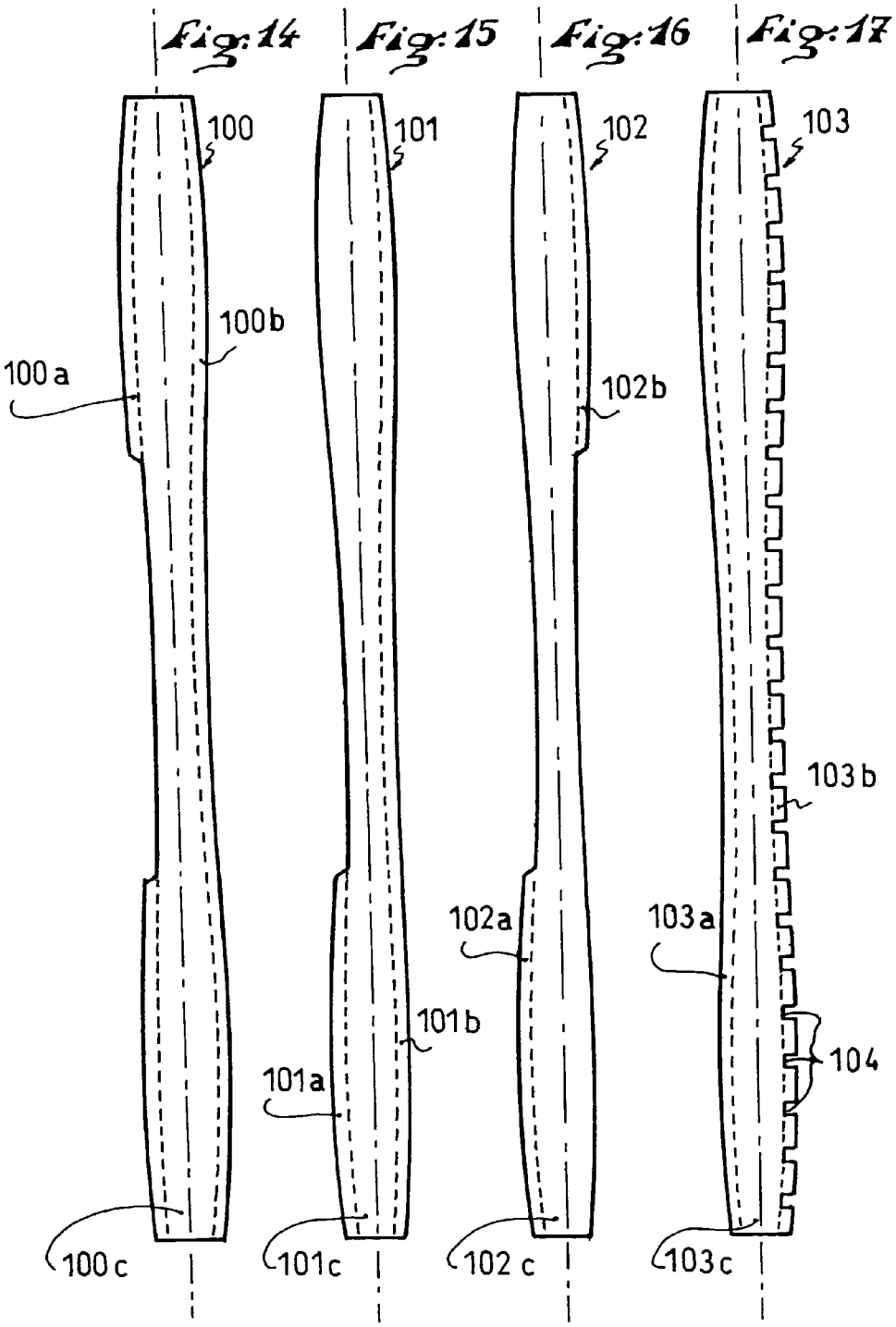

According to FIG. 14, the reinforcement 100 has a discontinuous lateral panel/portion 100*a* that extends over the entire length of the reinforcement, except in its central zone. The other reinforcement 100*b* extends over the entire length.

In FIG. 15, the lateral panel/portion 101*a* only extends in the rear portion of the reinforcement; the other lateral panel/portion extends over the entire length.

In FIG. 16, the reinforcement 102 has a lateral panel/portion 102*a* that extends in the rear portion, and the other lateral panel/portion 102*b* that extends in the front portion of the reinforcement.

Finally, FIG. 17 shows another embodiment of the invention with a reinforcement 103, one panel of which, in this case the panel/portion 103*a*, is continuous over the length of the reinforcement, and the other panel/portion, namely, the panel/portion 103*b*, is discontinuous and has notches 104 made over a length corresponding to the height of the edge of the ski.

Other constructions of having the reinforcements cut are also possible within the scope of the invention.

When the upper sub-assembly is formed of a plurality of superimposed reinforcement layers, each of the layers can be made according to the same construction, or according to different cutting methods.

According to the invention, it is sufficient that one of the upper reinforcement layers has an asymmetrical structure in the area of its lateral panels/portions.

The invention is not limited to the particular embodiments that have been described and other variations are possible. In particular, the various constructions described and shown can be combined with one another.

Also, instead of covering the entire length of the ski, the upper reinforcement layers, or a portion of them, could cover only a portion of the ski length.

What is claimed is:

1. A ski comprising:

an upper surface;

a gliding sole having a gliding surface;

a pair of opposite side walls;

a central core;

a lower reinforcement sub-assembly located beneath the core and above the gliding sole, and a pair of lateral running edges;

an upper reinforcement sub-assembly located above the central core and having at least two upper reinforcement layers;

a decoration layer coating the ski;

at least one of the upper reinforcement layers having a central portion covering the top of the core, and at least one lateral portion extending downwardly toward one of the running edges;

at least a portion of a longitudinal extent of at least one of the reinforcement layers of the upper reinforcement sub-assembly having an asymmetrical structure in an area of one of the lateral portions.

2. A ski according to claim 1, wherein:

the upper reinforcement sub-assembly has at least one upper reinforcement layer having a central portion and a lateral portion on only one side of the central portion, over at least a portion of the ski length.

3. A ski according to claim 2, wherein:

each of the two upper reinforcement layers having superimposed central portions and a single lateral portion, the lateral portions of said layers extending downwardly along the two sides of the ski toward the running edges, over at least a portion of the ski length.

4. A ski according to claim 2, wherein:

the upper reinforcement sub-assembly has at least one upper reinforcement layer having a central portion and a single lateral portion, and an upper reinforcement layer having a central portion and two lateral portions extending downwardly along the two lateral sides of the ski.

5. A ski according to claim 3, wherein:

the reinforcement layers are made of identical material.

6. A ski according to claim 3, wherein:

the reinforcement layers are made of non-identical material.

7. A ski according to claim 1, wherein:

the central portion of at least one of said two upper reinforcement layers is extended by a flap located on the side opposite a lateral portion.

8. A ski according to claim 1, wherein:

the central portion of at least one of said two upper reinforcement layers is truncated and set back from a lateral edge of the core, on a side opposite a lateral portion.

9. A ski according to claim 1, wherein:

at least over a portion of a length of a side of the ski, only one of the sides is covered by a lateral portion extending from at least one of said two upper reinforcement layers.

10. A ski according to claim 1, wherein:

said at least one lateral portion is discontinuous over the length of the ski.

* * * * *